US009869097B2

(12) United States Patent
Fernandez Fernandez

(10) Patent No.: US 9,869,097 B2
(45) Date of Patent: Jan. 16, 2018

(54) VENTILATED FACADE

(71) Applicant: CUPA INNOVACION S.L.U., Vigo-Pontevedra (ES)

(72) Inventor: Javier Fernandez Fernandez, Vigo-Pontevedra (ES)

(73) Assignee: CUPA INNOVACION S.L.U., Vigo-Ponteverdra (ES)

( * ) Notice: Subject to any disclaimer, the term of this patent is extended or adjusted under 35 U.S.C. 154(b) by 0 days.

(21) Appl. No.: 15/519,045

(22) PCT Filed: Apr. 8, 2016

(86) PCT No.: PCT/ES2016/070240

§ 371 (c)(1),
(2) Date: Apr. 13, 2017

(87) PCT Pub. No.: WO2016/166395

PCT Pub. Date: Oct. 20, 2016

(65) Prior Publication Data

US 2017/0226747 A1 Aug. 10, 2017

(30) Foreign Application Priority Data

Apr. 15, 2015 (ES) ..... 201530505

(51) Int. Cl.
*E04F 13/08* (2006.01)
*E04F 13/14* (2006.01)

(52) U.S. Cl.
CPC ..... *E04F 13/0805* (2013.01); *E04F 13/083* (2013.01); *E04F 13/0825* (2013.01); *E04F 13/0826* (2013.01); *E04F 13/142* (2013.01)

(58) Field of Classification Search
CPC ..... E04F 13/0805; E04F 13/0825; E04F 13/0826; E04F 13/083; E04F 13/142
USPC ... 52/235, 511, 489.1, 512, 546, 348, 302.3, 52/302.1
See application file for complete search history.

(56) References Cited

U.S. PATENT DOCUMENTS 6,055,787 A * 5/2000 Gerhaher ..... E04F 13/0826 52/506.06
6,289,644 B1 * 9/2001 Gerhaher ..... E04F 13/0826 52/235

(Continued)

FOREIGN PATENT DOCUMENTS

CH 659679 A5 2/1987
DE 202010000520 U1 8/2010

(Continued)

OTHER PUBLICATIONS

Machine translation for Foreign reference EP 0288376, obtained from http://translationportal.epo.org/emtp/translate/?ACTION=description-retrieval&COUNTRY=EP&ENGINE=google&FORMAT=docdb&KIND=A1&LOCALE=en_EP&NUMBER=0288376&OPS=ops.epo.org/3.2&SRCLANG=fr&TRGLANG=en (last accessed on Sep. 21, 2017).*

(Continued)

*Primary Examiner* — Theodore Adamos
(74) *Attorney, Agent, or Firm* — Lucas & Mercanti, LLP

(57) ABSTRACT

A ventilated facade comprising horizontal rails (4) and covering pieces (3-3') mounted on the horizontal rails by means of anchoring elements (5), either wires or plates, which hang from the rails through openings (13) that said rails have on a horizontal section (6) of the same.

10 Claims, 7 Drawing Sheets

(56) References Cited

U.S. PATENT DOCUMENTS

| | | | | |
|---|---|---|---|---|
| 2004/0074188 | A1* | 4/2004 | Beck | E04F 13/0841 52/522 |
| 2008/0010922 | A1* | 1/2008 | Wagner | E04F 13/0812 52/235 |
| 2012/0104202 | A1* | 5/2012 | Lukaszewicz | E04F 13/083 248/223.41 |
| 2013/0025235 | A1* | 1/2013 | Minamikawa | E04F 13/00 52/705 |
| 2013/0205698 | A1* | 8/2013 | Todd | E04F 13/0805 52/302.1 |
| 2013/0312352 | A1* | 11/2013 | Gale | E04F 13/24 52/483.1 |

FOREIGN PATENT DOCUMENTS

| | | | | |
|---|---|---|---|---|
| EP | 0167032 | A2 | 1/1986 | |
| EP | 0288376 | A1 * | 10/1988 | E04F 13/0803 |
| EP | 2299025 | A2 | 3/2011 | |
| NL | 8701061 | A | 12/1988 | |

OTHER PUBLICATIONS

International Search Report and Written Opinion dated Sep. 20, 2016 for PCT/ES2016/070240.

* cited by examiner

VENTILATED FACADE

CROSS REFERENCE TO RELATED APPLICATION

This Application is a 371 of PCT/ES2016/070240 filed on Apr. 8, 2016, which claims priority of Spanish Application No. P201530505 filed Apr. 15, 2015, both of which are incorporated herein by reference.

FIELD OF THE INVENTION

The present invention relates to a ventilated facade, made up of covering pieces, such as slate, natural stone, ceramic or metal panels, plastic, composite panels, fiber cement, etc., which are mounted on horizontal rails fixed to vertical rails anchored to the wall which is to be covered, or directly to said wall. The covering pieces are mounted on the rails by means of anchoring hook elements which hang from said rails.

BACKGROUND OF THE INVENTION

Ventilated facades are facades that have an air chamber between the cladding and the wall of the facade. This air chamber creates a "chimney effect", which provides continuous ventilation due to the temperature differences between the air outside and the air inside the chamber.

Among the different types of ventilated facades, facades in which the cladding is made up of slate pieces which are mounted by means of wire or plate anchoring elements on horizontal rails, generally made of wood, fixed to the wall of the façade, are known.

In this sense, CH 659679 and EP0167032 may be cited, in which the mounting of the covering pieces is carried out by means of anchoring pieces comprising a straight section, the ends of which have folds in opposite directions, consisting of hooks with different widths. On the wider hook, which is inverted, the anchoring piece of the rails is hung, and the upper edge of a panel belonging to a lower row of panels is inserted between the rail and the straight section of the anchoring piece, while the hook with the smaller width supports the lower edge of a panel belonging to an upper row of panels. In EP 0167032, the outer limb of the thicker hook can be laterally extended in a loop that is housed in the rail and serves as a support means, in an ascending direction, for the hook on said rail.

With this constitution, in the case of using panels with different thicknesses in the same row, on the visible covering surface there are areas located on different planes due to the fact that the anchoring piece does not have the ability to adjust to different thicknesses.

DESCRIPTION OF THE INVENTION

The present invention relates to a ventilated facade made up of a cladding constituted of covering pieces of any nature (slate, granite, plastic, plate, fiber cement, etc.), which are mounted on metal rails by means of wire or plate anchoring elements.

The cladding of the facade enables a long-lasting and attractive finish to be obtained, in comparison with cladding of wood or prefabricated panels.

Metal rails offer greater performance and resistance to moisture and possible fires in comparison with wood.

The wire, metal rod or plate anchoring elements are made up such that they have the capacity to absorb or adjust to possible differences in thickness of the slate pieces, which enables a surface that appears essentially flat to be obtained.

The ventilated facade of the invention is of the aforementioned type, made up of covering pieces mounted to the horizontal rails by means of wire or plate anchoring elements which hang from the rails, through openings of said rails.

According to the present invention, the anchoring elements adopt a U shape and are hung in an inverted position from the horizontal rails, with a rear lateral limb inserted through the openings on the rails, and with a front lateral limb which runs in a descending direction in front of the rails. The aforementioned front lateral limb ends at a fold which is in an ascending direction, forming an outer hook, on which the lower edge of a cladding piece is supported, belonging to an upper row of covering pieces. In turn, the rear lateral limb, inserted through the openings on the rails, has an inner protrusion which, with the front limb of the U, determines a narrowing of width which is less than the thickness of the covering pieces. Inserted through this narrowing is the upper edge of a covering piece which belongs to a lower row of covering pieces.

The aforementioned inner protrusion of the rear limb of the U can be obtained by means of transversal structures made in said rear lateral limb. The inner protrusion may also be constituted of a spring which is fixed to the inner surface of the rear lateral limb of the U.

With regard to the horizontal rails on which the covering pieces are fixed, they have a split profile, made up of three sections, one central section and two end sections perpendicular to the central section and in opposite directions. Throughout the outer surface of one of the end sections, these rails have a wing which is parallel to the central section of the rail. Located in the aforementioned wing are the openings through which the rear limb of the U which makes up the anchoring elements is inserted. Moreover, this wing ends in a longitudinal support which secures the positioning of the anchoring elements on the rail.

The transversal structures of the rear lateral limb of the anchoring elements may consist of an end fold toward the inside of the U and which defines a narrowing in the mouth of said U, which elastically supports the upper edge of a covering piece inserted between said fold and the front lateral limb of the U.

The transversal structures of the rear lateral limb of the anchoring elements may also consist of intermediate folds toward the inside of the U, folds which form an inner protrusion inside the U and which elastically supports the upper edge of a covering piece inserted between the aforementioned intermediate fold and the front lateral limb of the U.

DESCRIPTION OF THE DRAWINGS

The characteristics and advantages of the invention are presented through a non-limiting exemplary embodiment, shown in the accompanying drawings, where.

DETAILED DESCRIPTION OF AN EMBODIMENT

Figure 1:
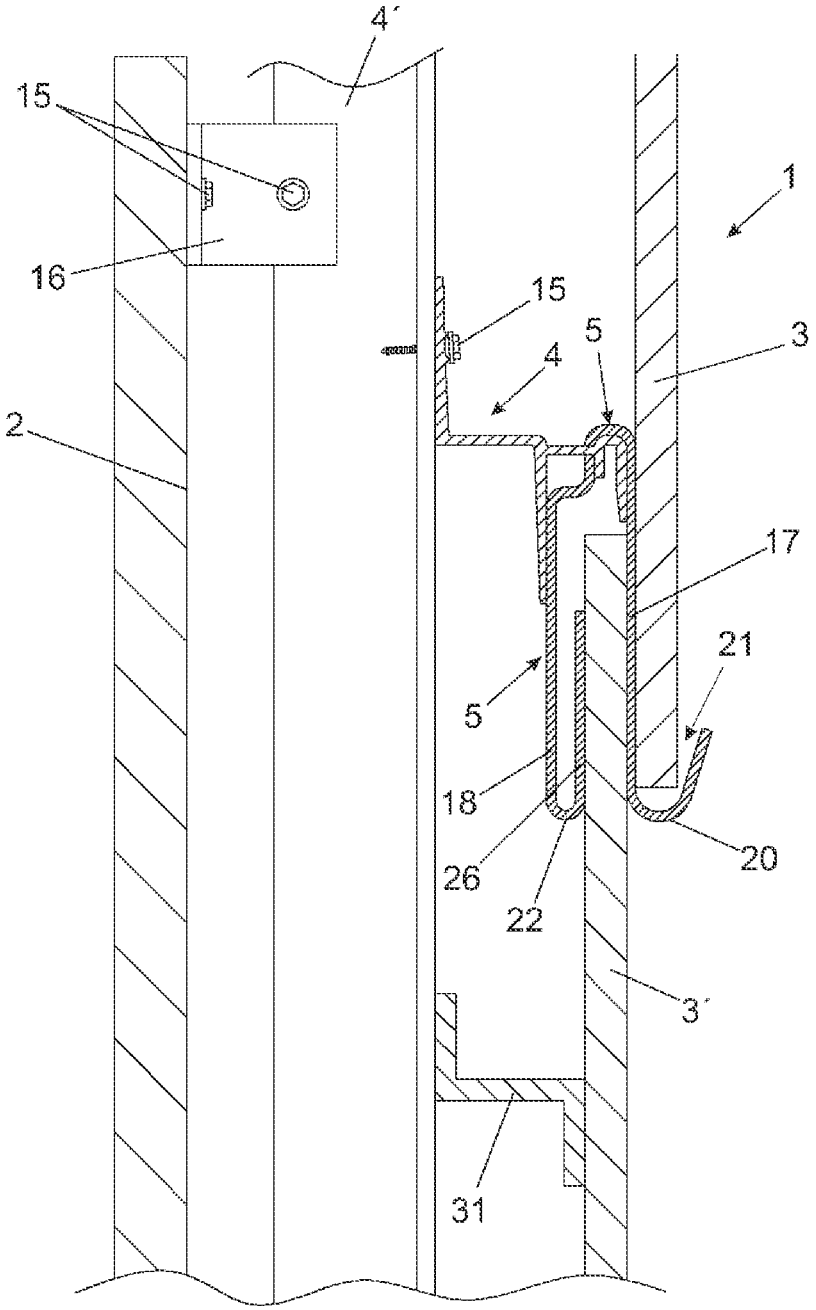
FIG. 1 shows a partial vertical cross section of a ventilated facade, constituted in accordance with the invention.

FIG. 1 shows a partial vertical cross section of a ventilated facade made up of a cladding (1), which is mounted on the wall (2) of the facade. The cladding (1) is made up of pieces (3-3') which are mounted in horizontal alignments on the horizontal rails (4) which are fixed to vertical rails (4') anchored to the wall (2) of facade, or directly on said wall.

The covering pieces are mounted on the rails by means of anchoring elements (5) which hang from the rails (4). The covering pieces (3-3') may be of any type, such as slate, granite, plastic, metal, fiber cement, etc.

Figure 2:
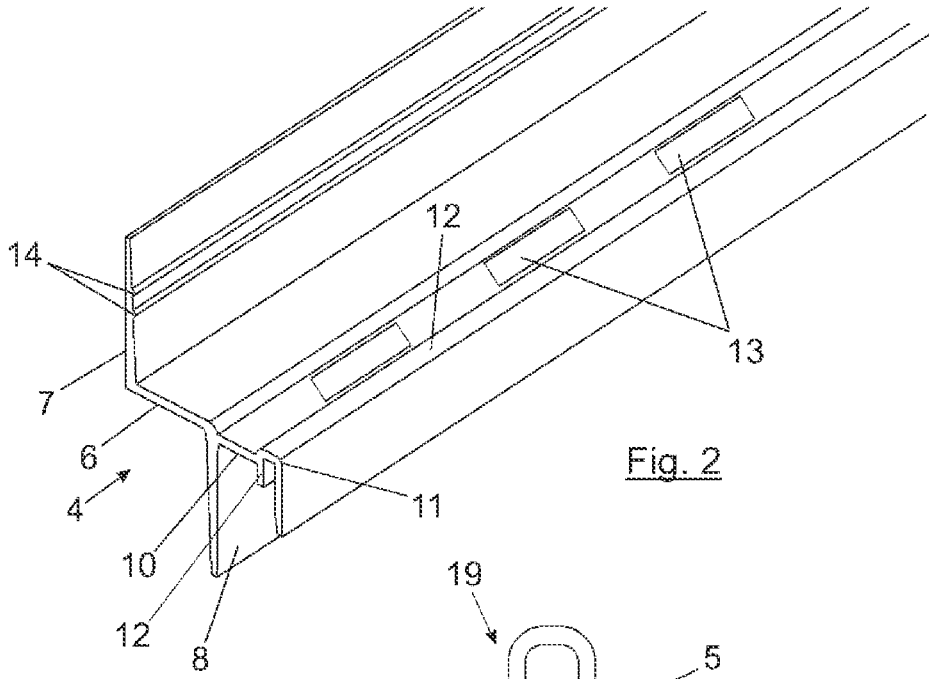
FIG. 2 shows a perspective cross section of one of the rails which form part of the facade in FIG. 1.

The rails (4) of FIG. 2, are metal and have a split profile made up of three consecutive sections, one central section (6) and two end sections (7 and 8) perpendicular to the central section (6) and in opposite directions.

From said end section (8), a wing (10), which is parallel and next to the section (6), protrudes along the same and ends at a longitudinal support (11) for the anchoring elements (5) in the form of an inverted canal with walls at different heights. The bottom (12) of this canal is approximately coplanar with the central section (6) of the rail (4).

The wing (10) has openings (13) along the same which serve to hang the anchoring elements (5).

Running along the end section (7), and through the inner surface thereof, are veins (14) for the positioning of fastening screws (15) for fastening the horizontal rails (4) to the vertical rails (4'), which may be fixed to the wall by means of brackets (16) and screws (15).

The anchoring elements (5'), FIGS. 3 to 7, adopt a U shape, with essentially parallel limbs (17 and 18). These anchoring elements are hung in an inverted position from the horizontal rails (4), FIG. 1, with the lateral limb (18), which we shall call rear lateral limb, inserted through the openings (13), while the lateral limb (17), which we shall call front lateral limb, runs in front of the rail. In turn, the central limb (19) of the U has an intermediate split, determining sections of different depths which may be coupled to the wing (10) and horizontal rail support (11).

The front lateral limb (17) ends at an outer fold (20) which is in an ascending direction, forming a hook (21), on which the lower edge of a covering piece (3) is supported, belonging to an upper row of covering pieces.

Figure 3:
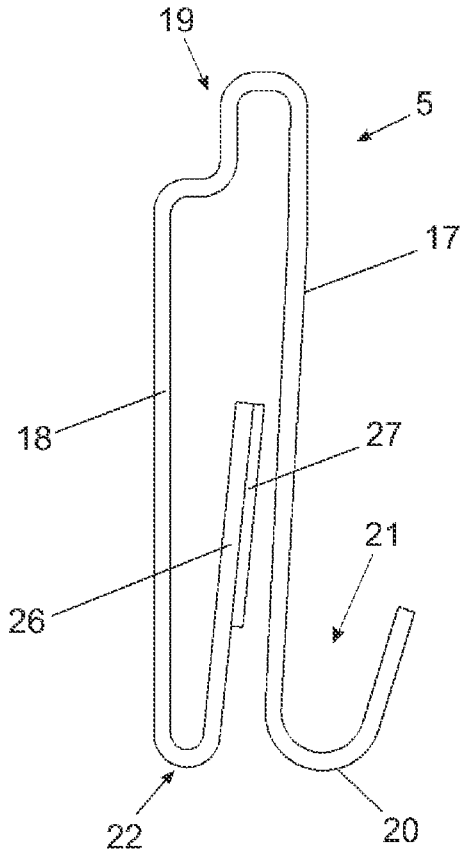
FIG. 3 shows a profile view of one of the anchoring elements of the covering pieces.
Figure 4:
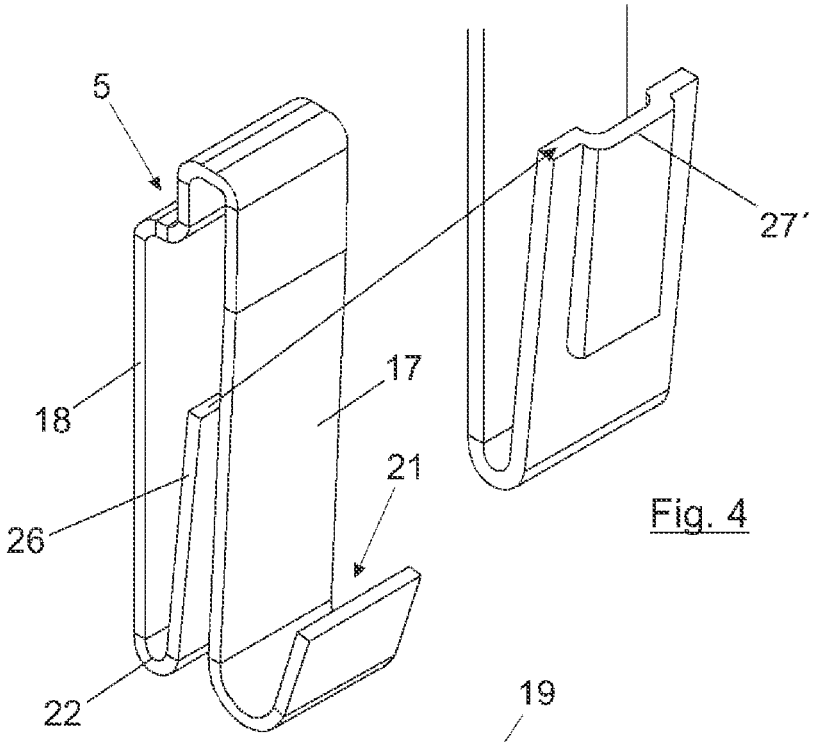
FIG. 4 shows a perspective view of a plate anchoring element.
Figure 5:
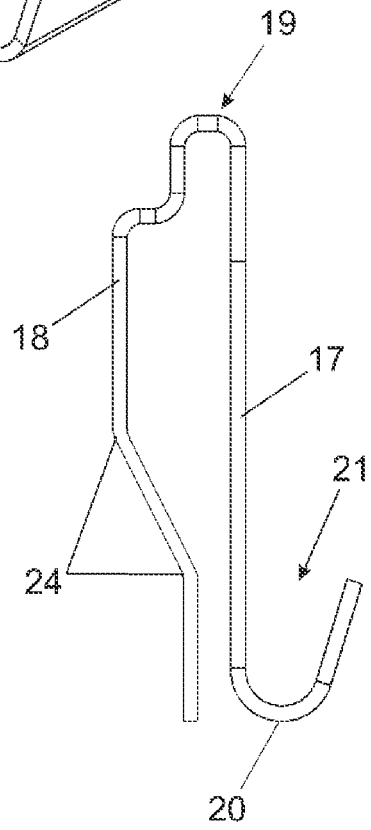
FIGS. 5 to 9 show profile views of several other variants of the anchoring element.
Figure 6:
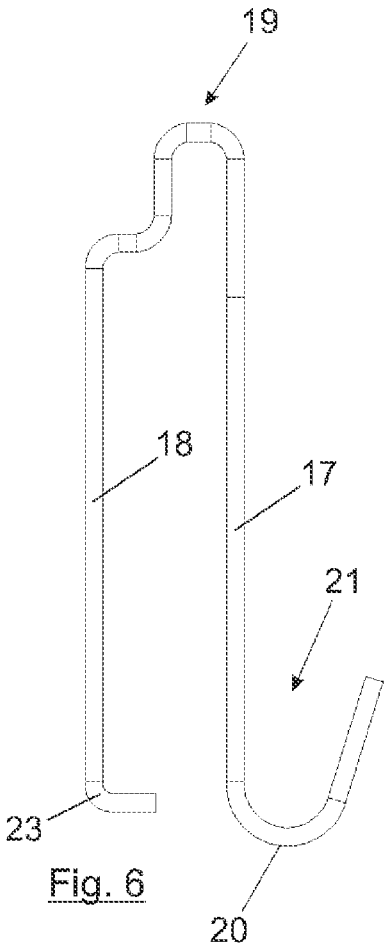
Figure 7:
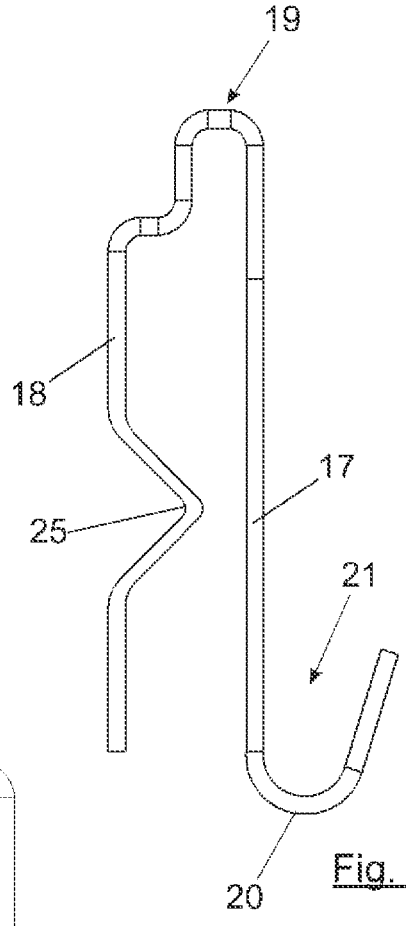

The rear lateral limb (18) has structures which may be defined by end folds in the form of a hook (22), FIGS. 3 and 4, directed towards the inside of said U, or in the form of an inner pin (23), FIG. 6. The aforementioned structures may also be defined by intermediate folds (24-25), FIGS. 5 and 7.

In any case, the aforementioned structures determine a narrowing in the interior of the U which will elastically support the upper portion of a covering piece (3') bellowing to a lower row of covering pieces partially inserted in the U, according to FIG. 1. The hook (22), the pin (23) and the folds (24 and 25) determine a narrowing inside the U which provides a spring effect which compresses the covering piece (3') against the front lateral limb (17) of the U. Therefore, the covering pieces (3') are pushed against the pieces (3), enabling them to absorb possible differences in thicknesses between the covering pieces, which enables each row of covering pieces to have a practically flat outer surface.

In the embodiment of FIG. 3, the end limb (26) of the hook (22) may be provided with a covering (27) of an elastically compressible material or a deformation (27'), FIG. 4, to enhance the aforementioned spring effect and provide better support for the covering pieces (3').

Figure 8:
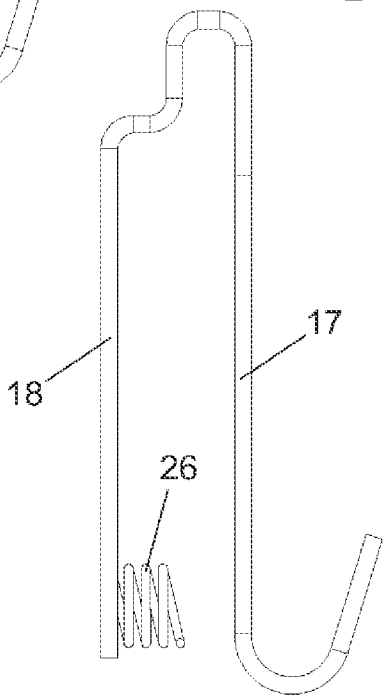
Figure 9:
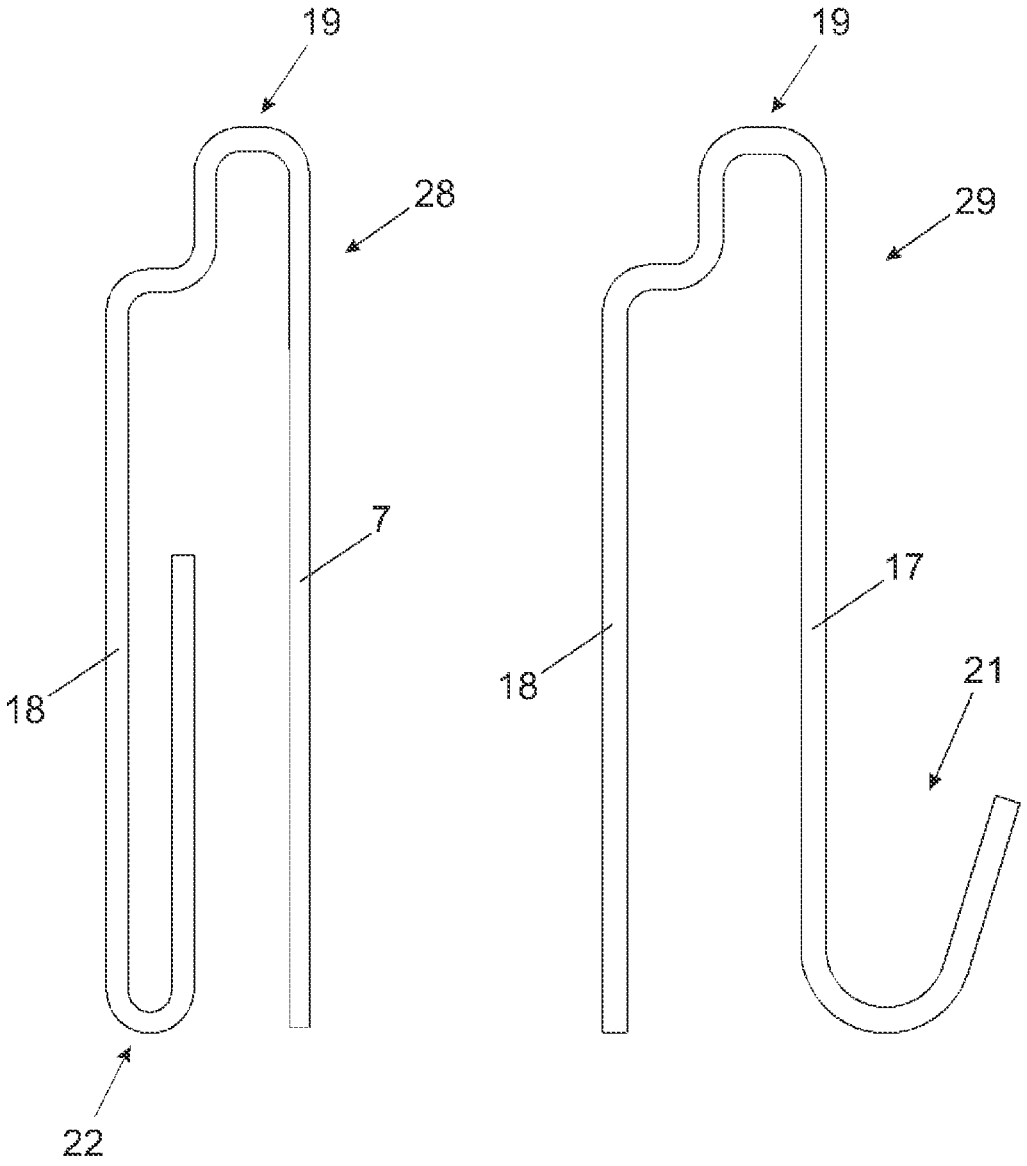

The anchoring element in FIGS. 3 and 4 could be subdivided into two independent pieces (28 and 29), FIG. 8, both in a U shape, which would hang on different openings (13) of the horizontal rails (4) through the rear lateral limb (18) thereof. The piece (29) serves to support the lower edge of the covering pieces (3) by means of the hook (21) thereof, while the piece (28) provide a spring effect through the hook (22), the spring effect that pushes the pieces (3') of a lower row against the pieces (3) of an upper row.

With the described components, for constructing the facade of the invention, the rails (4) are then fixed in a horizontal position on the vertical rails (4') anchored to the wall (2), or directly on said wall. The anchoring elements (5) are then mounted, inserting the limb (18) and the hook (22) through the openings (13) of the rail (4). Once the anchoring elements are mounted, the covering piece (3) is supported on an upper row of pieces on the hook (21) by the lower edge of said pieces (3). At the same time, the upper edge of the covering pieces (3') which belong to a lower row of pieces is inserted in the U, these pieces (3') being compressed between the side (26) of the hook (22) or on the covering (27), which acts as a spring, and the limb (17) of the U, all in accordance with FIG. 1.

Through the limb (18), the anchoring element is supported on the end limb (8) of the rails (4). The central limb (19) of the anchoring piece has a structure which enables it to be securely attached to the rail (4).

By inserting the hook (22) of the anchoring element (5) through the slot (13), the horizontal movements of said anchoring are blocked, with respect to the rail.

The inner narrowing of the U, which provides the aforementioned spring effect, can also be achieved by means of the arrangement of a spring (30) fixed to the inner surface of the rear limb (18) of the U, FIG. 8. Between this spring (30) and the front lateral limb (17) of the U, the upper edge of a covering piece (3') is inserted, belonging to a lower row of covering pieces.

Between the surface of the wall (2) and the covering elements (3-3'), vertical chambers are delimited that, due to the so-called "chimney effect", keep a continuous ventilation due to the temperature differences between the outside and inside said chamber.

To improve resistance to impacts against the cladding, the covering pieces may incorporate a fiberglass mesh, fixed, for example, using resin. Intermediate support profiles (31), FIG. 1, may also be installed between the covering pieces (3-3') and the vertical rails (4').

Figure 10:
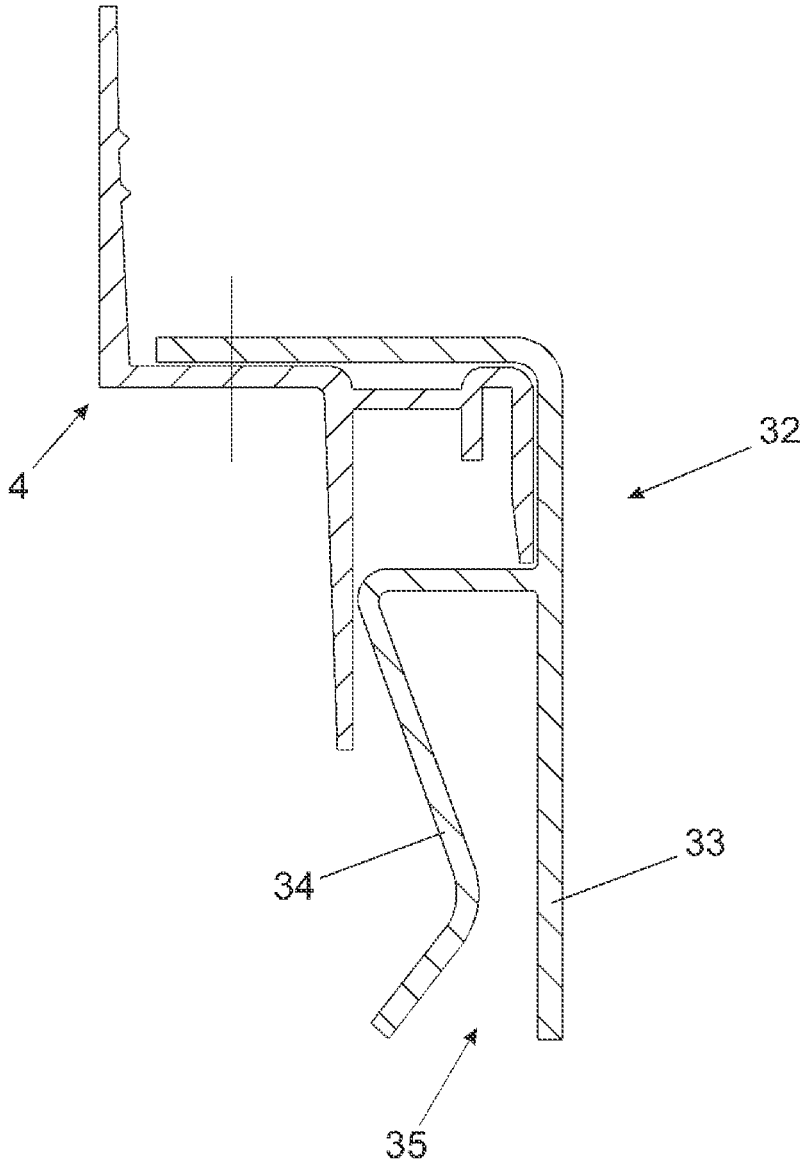
FIG. 10 shows a cross section of an auxiliary profile for mounting covering pieces at difficult access points.

To mount the covering pieces in special areas of the facade, for example where there are window joins, balconies or corners, where anchoring elements may not be placed, or where the fastening must be reinforced, auxiliary pieces (32) may be used with the profile shown in FIG. 10, which are fixed to the rails (4) by means of screwing. The covering pieces are inserted between the pins (33 and 34), which form an inverted gripper (35), and through the pin (33) they may or may not be fixed with screws, depending on the specific conditions of the placement of the covering pieces in each case.

Figure 11:
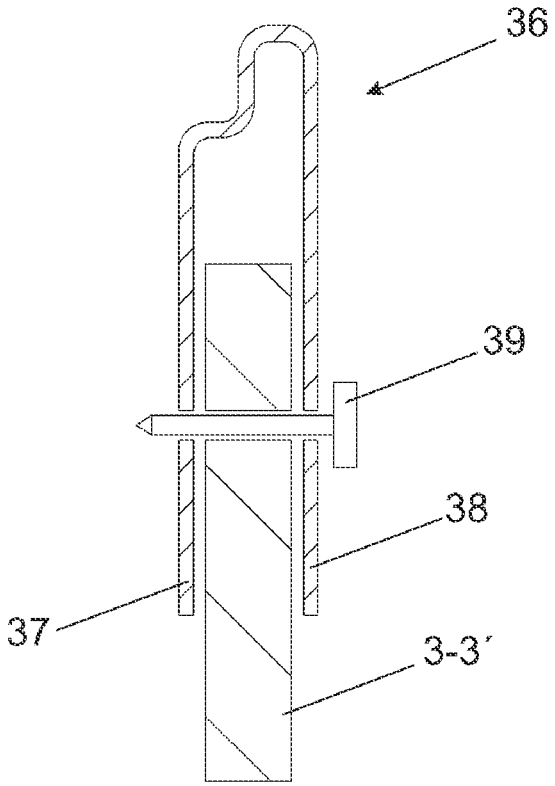
FIG. 11 shows a possible variant of the auxiliary profile of FIG. 10.

FIG. 11 shows, for the same purpose, an auxiliary piece (36), in the shape of an inverted U, which is mounted on horizontal rails in the same way as that which is described with reference to FIG. 1, and between the limbs (37 and 38) thereof, which form an inverted gripper (35), the upper edge of the covering pieces (3-3') is inserted, which may be fastened by means of screws (39).

The invention claimed is:

1. A ventilated facade, which comprises horizontal rails, covering pieces and anchoring elements, the horizontal rails of which have a split profile made up of three sections, one central section and two end sections perpendicular to the central section and in opposite directions, and the anchoring elements of which are wire or plate and by which the covering pieces are mounted on the rails, wherein:

the horizontal rails have a wing along an outer surface of one of the end sections thereof, parallel to the central section of the rail, the wing of which has openings from which anchoring elements hang, and ends at a longitudinal support for the anchoring elements;

the anchoring elements have a U shape and are hung in an inverted position from the horizontal rails with a rear lateral limb inserted through the openings of said rails, and a front lateral limb running in a descending direction in front of the rail, the front lateral limb of which ends at a fold in an ascending direction, forming an outer hook supporting a lower edge of a covering piece belonging to an upper row of covering pieces, the rear lateral limb of which has an inner protrusion which determines, with the front limb of the U shape, a narrowing width less than the thickness of a covering piece through which an upper edge of said covering piece is inserted which belongs to a lower row of covering pieces.

2. The facade according to claim 1, wherein the longitudinal support is configured in the form of an inverted canal, a bottom of which is parallel to and approximately coplanar with the central section of the rail and walls of which are parallel to the end sections of said rail.

3. The facade according to claim 1, wherein intermediate longitudinal ribs protrude from one of the end sections of the horizontal rail through an inner surface.

4. The facade according to claim 1, wherein the inner protrusion of the rear limb of the U shape is made up of transversal structures of said rear lateral limb.

5. The facade according to claim 4, wherein the transversal structures of the rear lateral limb of the U shape consist of an end fold toward the inside of the U shape, which defines a narrowing of the mouth of said U shape and elastically supports the upper edge of a covering piece inserted between said fold and the front lateral limb of the U shape.

6. The facade according to claim 5, wherein the end fold of the rear limb of the U shape forms a hook coplanar with the U-shape and toward the inside of the same, which elastically supports the upper edge of a covering piece inserted between said hook and the front lateral limb.

7. The facade according to claim 4, wherein the transversal structures of the rear lateral limb of the U shape consist of intermediate folds toward the inside of the U shape, which elastically support the upper edge of a covering piece inserted between said intermediate fold and the front lateral limb of the U shape.

8. The facade according to claim 1, wherein the inner protrusion of the rear limb of the U shape consists of a spring which is fixed on the inner surface of said rear lateral limb.

9. The facade according to claim 1, wherein the anchoring elements comprise two independent U-shape pieces which are hung in an inverted position from the horizontal rails, a first piece forming transversal structures in the rear lateral limb thereof, and a second piece, the front lateral limb of which forms the outer hook.

10. The facade according to claim 1, further comprising auxiliary anchoring elements to secure the covering pieces belonging to a same row of pieces, the auxiliary anchoring elements of which are mounted on the horizontal rails and form an inverted gripper for receiving the upper edge of a covering piece belonging to a row of covering pieces.

* * * * *